US011603279B2

(12) United States Patent
Yang et al.

(10) Patent No.: US 11,603,279 B2
(45) Date of Patent: Mar. 14, 2023

(54) PACKAGE STRUCTURE OF ROLL-SHAPED THIN FILM AND PACKAGING METHOD THEREOF

(71) Applicant: CHANG CHUN PETROCHEMICAL CO., LTD., Taipei (TW)

(72) Inventors: Ming-Yu Yang, Taipei (TW); Yao-Sheng Lai, Taipei (TW); Jui-Chang Chou, Taipei (TW)

(73) Assignee: CHANG CHUN PETROCHEMICAL CO., LTD., Taipei (TW)

( * ) Notice: Subject to any disclaimer, the term of this patent is extended or adjusted under 35 U.S.C. 154(b) by 19 days.

(21) Appl. No.: 17/477,506

(22) Filed: Sep. 16, 2021

(65) Prior Publication Data

US 2022/0089396 A1 Mar. 24, 2022

Related U.S. Application Data

(60) Provisional application No. 63/083,033, filed on Sep. 24, 2020.

(30) Foreign Application Priority Data

Aug. 30, 2021 (TW) ..... 110132105

(51) Int. Cl.
*B65H 18/28* (2006.01)

(52) U.S. Cl.
CPC ..... *B65H 18/28* (2013.01); *B65H 2701/173* (2013.01); *B65H 2701/1864* (2013.01); *B65H 2701/18442* (2013.01)

(58) Field of Classification Search
CPC ..... B65H 18/28; B65H 19/29; B65H 2701/1864; B65H 2701/18442; B65D 65/02; B65D 65/38; B65B 11/04
See application file for complete search history.

(56) References Cited

U.S. PATENT DOCUMENTS

| | | | | | |
|---|---|---|---|---|---|
| 4,148,395 | A * | 4/1979 | Syracuse | G03B 17/26 | 396/511 |
| 5,472,089 | A * | 12/1995 | Specogna | G03B 27/588 | 206/413 |
| 6,048,676 | A * | 4/2000 | De Leener | G03C 3/00 | 430/501 |
| 6,619,478 | B2 * | 9/2003 | Fukugawa | B65D 65/16 | 206/413 |
| 2017/0341798 | A1 * | 11/2017 | Hawkins | B65B 63/04 | |

FOREIGN PATENT DOCUMENTS

| | | | |
|---|---|---|---|
| CN | 203268639 | U | 11/2013 |
| CN | 205891697 | U | 1/2017 |
| JP | 2000-128271 | A | 5/2000 |
| JP | 2005-74829 | A | 3/2005 |
| JP | 2007-112477 | A | 5/2007 |
| JP | 2008-239182 | A | 10/2008 |
| JP | 2010-285194 | A | 12/2010 |
| WO | 2010/084401 | A1 | 7/2010 |

* cited by examiner

*Primary Examiner* — Sang K Kim
(74) *Attorney, Agent, or Firm* — Winston Hsu

(57) ABSTRACT

A package structure of a roll-shaped thin film includes a thin film roll and a buffer layer. The thin film roll includes a winding core and a thin film wound around the winding core, and the buffer layer is wound around an outer circumference of the thin film. An end portion of the buffer layer is covered with an inner surface of an end portion of the thin film, and the thickness of the buffer layer is in a range of 1-20 mm.

18 Claims, 10 Drawing Sheets

PACKAGE STRUCTURE OF ROLL-SHAPED THIN FILM AND PACKAGING METHOD THEREOF

CROSS REFERENCE TO RELATED APPLICATIONS

The application claims the benefit of U.S. provisional application Ser. No. 63/083,033, filed on Sep. 24, 2020, the disclosure of which is incorporated herein by reference in its entirety.

BACKGROUND OF THE INVENTION

1. Field of the Invention

The present disclosure relates to a package structure of a roll-shaped thin film, in particular to the package structure of the roll-shaped thin film with reduced damages to the roll-shaped thin film and a packaging method thereof.

2. Description of the Prior Art

For film-shaped products, such as a metal foil or a polymer film, the film-shaped products are usually wound around a winding core to be a roll-shaped thin film so that these products can be transported conveniently.

FIG. 1 is a schematic perspective view of a roll-shaped thin film wrapped in a buffer layer according to a prior art. Referring to FIG. 1, generally, in order to protect a roll-shaped thin film 12 from damages caused by collisions during transportation, a buffer layer 14 is usually disposed along an arc-shaped outer circumference 12S of the roll-shaped thin film 12 or further disposed at both ends of the roll-shaped thin film 12 for protecting the roll-shaped thin film. In addition, in order to prevent a relative displacement between the buffer layer 14 and the roll-shaped thin film 12, an adhesive tape 16 is generally used to attach one end portion of the buffer layer 14 to the arc-shaped outer circumference 12S of the roll-shaped thin film 12.

However, it is generally necessary to apply a certain external force (for example, an external force toward the winding core) to the adhesive tape 16 when attaching one end portion of the buffer layer 14 to the arc-shaped outer circumference 12S of the roll-shaped thin film 12, so that one end portion of the adhesive tape 16 is adhered to the arc-shaped outer circumference 12S of the roll-shaped thin film 12. The external force may not only be applied to the adhesive tape 16, but also be applied to the roll-shaped thin film 12 under the adhesive tape 16. Since the roll-shaped thin film 12 is easily deformed plastically by the external force, or the surface structure of the roll-shaped thin film 12 is easily damaged by the external force, the roll-shaped thin film 12 in a certain depth below the adhesive tape 16 is usually damaged during the aforementioned process of adhering the adhesive tape 16. Therefore, these damaged sections of the roll-shaped thin film 12 would not be used due to the deformation of these sections, thus causing an increase in the cost.

Therefore, there is still a need to provide a package structure of a roll-shaped thin film and a packaging method thereof to solve the drawbacks in the prior art.

SUMMARY OF THE INVENTION

In view of the above, the present disclosure provides a package structure of a roll-shaped thin film and a packaging method thereof, which solve the drawbacks existing in the prior art.

According to one embodiment of the present disclosure, a package structure of the roll-shaped thin film is provided and includes a thin film roll and a buffer layer. The thin film roll includes a winding core and a thin film wound around the winding core, and the buffer layer is wound around an outer circumference of the thin film. A portion of the buffer layer is attached to the end portion of the thin film. In particular, one end portion of the buffer layer is covered with an inner surface of an end portion of the thin film, and the thickness of the buffer layer is in a range of 1-20 mm.

According to another embodiment of the present disclosure, a packing method of a roll-shaped thin film is provided and includes: obtaining a thin film roll, where the thin film roll includes a winding core and a thin film wound around the winding core; obtaining a buffer layer; covering one end portion of the buffer layer with an inner surface of an end portion of the thin film so as to form an overlapping region between the end portion of the buffer layer and the end portion of the thin film; attaching at least one portion of the end portion of the thin film to the buffer layer, in which the at least one portion of the end portion of the thin film overlaps with the overlapping region; and winding the buffer layer around an outer circumference of the thin film after attaching the at least one portion of the end portion of the thin film to the buffer layer.

According to the aforementioned embodiments, since one end portion of the buffer layer is covered with the inner surface of the end portion of the film, the buffer layer may be sandwiched between the inner surface of the end portion of the thin film and the outer circumference of its underlying thin film of the next round. Therefore, even if an external force toward the winding core is applied to the end portion of the thin film, the external force may be absorbed by the buffer layer completely or partially. Therefore, the roll-shaped thin film under the buffer layer may only bear a slight external force, thus protecting the roll-shaped thin film from damages.

These and other objectives of the present invention will no doubt become obvious to those of ordinary skill in the art after reading the following detailed description of the preferred embodiment that is illustrated in the various figures and drawings.

DETAILED DESCRIPTION

To provide a better understanding of a package structure of a roll-shaped thin film and a packaging method thereof according to the present disclosure to those of ordinary skill in the art, several exemplary embodiments of the present disclosure will be detailed as follows, with reference to the accompanying drawings using numbered elements to elaborate the contents and effects to be achieved. The accompanying drawings are included to provide a further understanding of the embodiments, and are incorporated in and constitute a part of this specification. These embodiments are described in sufficient detail to enable those skilled in the art to practice the invention. Other embodiments may be utilized and that structural, logical and electrical changes may be made without departing from the spirit and scope of the present disclosure.

It should be readily understood that the meaning of "on," "above," and "over" in the present disclosure should be interpreted in the broadest manner such that "on" not only means "directly on" something but also includes the meaning of "on" something with an intermediate feature or a layer therebetween, and that "above" or "over" not only means the meaning of "above" or "over" something but may also include the meaning it is "above" or "over" something with no intermediate feature or layer therebetween (i.e., directly on something).

At the very least, each numerical parameter should at least be construed in light of the number of reported significant digits and by applying ordinary rounding techniques. Ranges may be expressed herein as from one endpoint to another endpoint or between two endpoints. All ranges disclosed herein are inclusive of the endpoints, unless specified otherwise.

The specific order of the blocks disclosed in the following flowchart is an illustration of exemplary approaches. It should be understood that, according to different design preferences, the specific order of the blocks disclosed in the following flowchart may be rearranged, the blocks may be combined or omitted, or additional block may be added to the illustrated blocks.

It should be noted that the technical features in different embodiments described in the following may be replaced, recombined, or mixed with one another to constitute another embodiment without departing from the spirit and the scope of the present disclosure.

A package structure of a roll-shaped thin film of the present disclosure includes at least a thin film roll and a buffer layer. In particular, the thin film roll includes a winding core and a thin film wound around the winding core. The buffer layer is wound around an outer circumference of the thin film, and one end portion of the buffer layer is covered with an inner surface of an end portion of the thin film. A portion of the buffer layer is attached to the end portion of the thin film. The thickness of the buffer layer is in a range of 1-20 mm.

Figure 1:
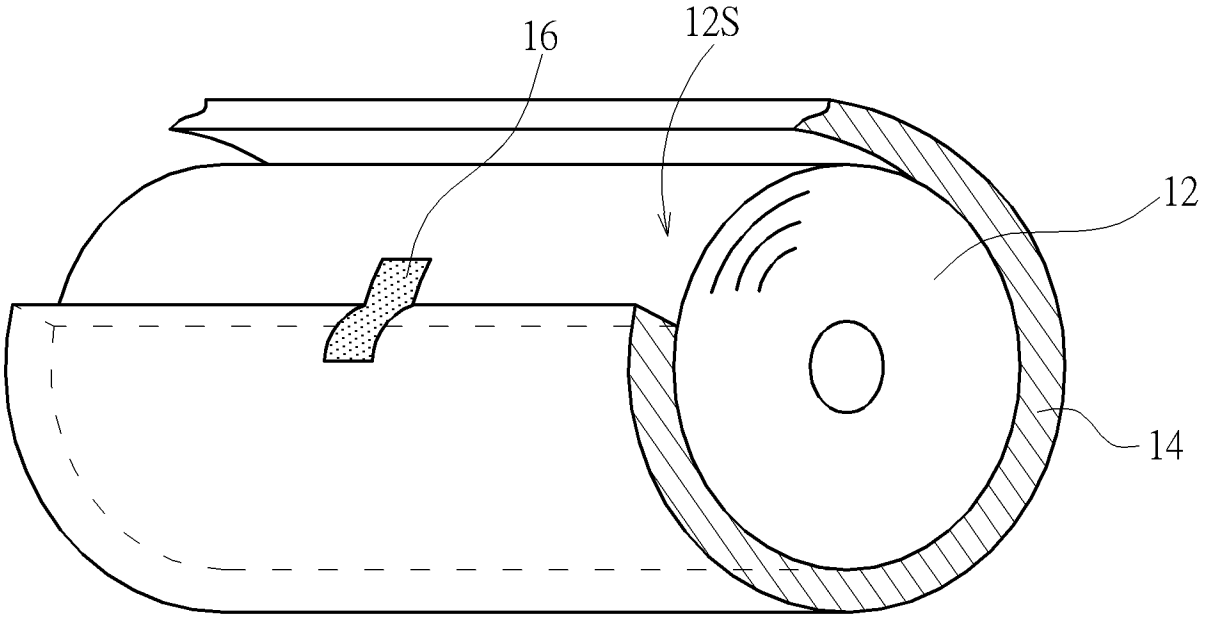
FIG. 1 PRIOR ART
FIG. 1 is a schematic perspective view of a roll-shaped thin film wrapped with a buffer layer according to a prior art.
Figure 2:
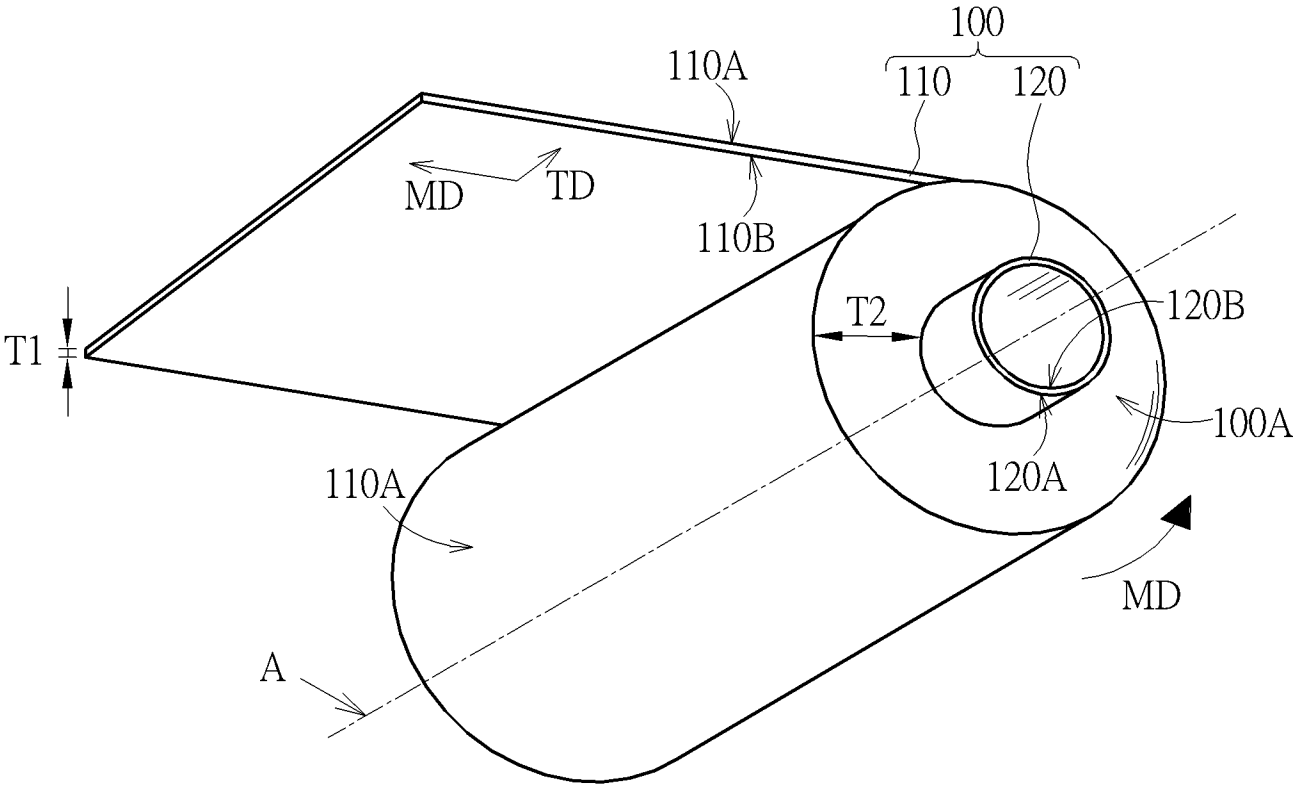
FIG. 2 is a schematic perspective view of a thin film roll according to one embodiment of the present disclosure.

According to one embodiment of the present disclosure, the package structure of a roll-shaped thin film includes a thin film roll, a buffer layer, a connecting element and an antirust film. FIG. 2 is a schematic perspective view of a thin film roll according to the embodiment of the present disclosure. Referring to FIG. 2, a thin film roll 100 includes a winding core 120 and a thin film 110. In particular, the winding core 120 is used to support the thin film 110, so that the wound thin film 110 may not collapse toward the center of the thin film roll 100, and the thin film 110 is a continuous layer wound around the outer circumference 120A of the winding core 110. Thus, the wound thin film 110 may have a cylindrical shape with an arc-shaped outer circumference 110A and have two ends 100A.

The winding core 120 may be a solid or hollow cylinder. When the center line A along the long axis of the cylinder is taken as the axis of rotation of the winding core 120, the thin film 110 may be wound or unwound by rotating the winding core 120 in forward or reverse directions. The winding core 120 is a hollow cylinder having an outer circumference 120A and an inner circumference 120B. There is a certain thickness between the outer circumference 120A and the inner circumference 120B in the radial direction, such as 1 cm to 15 cm, but is not limited thereto. The hollow portion of the winding core 120 may be used to accommodate a rod-shaped shaft (not shown), so that the winding core 120 may be driven to rotate by rotating the shaft. The material of the winding core 120 may be paper, wood, metal, resin (polyethylene, polypropylene, polyvinyl chloride, polystyrene, polyimide, polyamide, acrylonitrile-butadiene-styrene resin, epoxy resin, polyester resin, polybutadiene rubber, nitrile-butadiene rubber, etc.), or reinforced resin, but not limited thereto.

The thin film 110 is a band-shaped continuous thin layer and includes two opposite surfaces, such as an outer circumference 110A and an inner circumference 110B. The thin film 110 is flexible, and its corresponding thickness T1 may be in a range of 1-210 μm, but is not limited thereto. During the process of continuously rotating the winding core 120 to wind the thin film 110, the inner circumference 110B of the outermost thin film 110 would cover the outer circumference 110A of the adjacent inner thin film 110 until the whole thin film 110 is wound to the end. The whole thin film 110 wound on the winding core 120 has a certain thickness T2 in the radial direction, such as 2 cm, 5 cm, 10 cm, 15 cm, 20 cm, 25 cm, 50 cm, or any other values falling within the range of 2 cm to 50 cm, but not limited thereto. In addition, the thin film 110 includes a mechanical direction MD (or a length direction) and a transverse direction TD (or a width direction) perpendicular to the mechanical direction. The thin film 110 moves substantially in the mechanical direction MD instead of the transverse direction TD during winding or unwinding the thin film 110.

The thin film 110 may be a metal foil (copper foil, aluminum foil, tin foil, alloy foil, etc.), a resin film (polyvinyl alcohol (PVA) film, polyvinyl butyral (PVB) film, ethylene-vinyl alcohol copolymer (EVOH) film, polyethylene terephthalate (PET) film, polybutylene terephthalate (PBT) film, polybutylene adipate terephthalate (PBAT) film, polybutylene succinate (PBS) film, thermoplastic polyester elastomer (TPEE) film, or composite films, but not limited thereto. Specifically, the metal foil may be, but not limited to, an electrodeposited foil or a rolled foil. In addition, because of the fact that the metal foil is more likely to be deformed irreversibly by an external force applied to it compared with the polymer film, when the thin film 110 is made of the metal foil, the buffer layer in the package structure of the roll-shaped thin film may effectively protect the metal foil from damages. Therefore, the thin film 110 of the package structure of the roll-shaped thin film of the present disclosure is preferably a metal foil.

The thin film 110 could be easily damaged by an external force applied to it since the thin film 110 is thin and/or at least one surface of the thin film 110 has microstructures. Therefore, by disposing the buffer layer on the outer circumference of the thin film roll 100, the outermost thin film 110 of the thin film roll 100 may be prevented from being plastically deformed by the external force, or the surface structure of the outermost thin film 110 may be protected from damages caused by the external force. According to the embodiment, the arrangement of the buffer layer in the package structure of the roll-shaped thin film is shown in FIG. 3 as an example.

Figure 3:
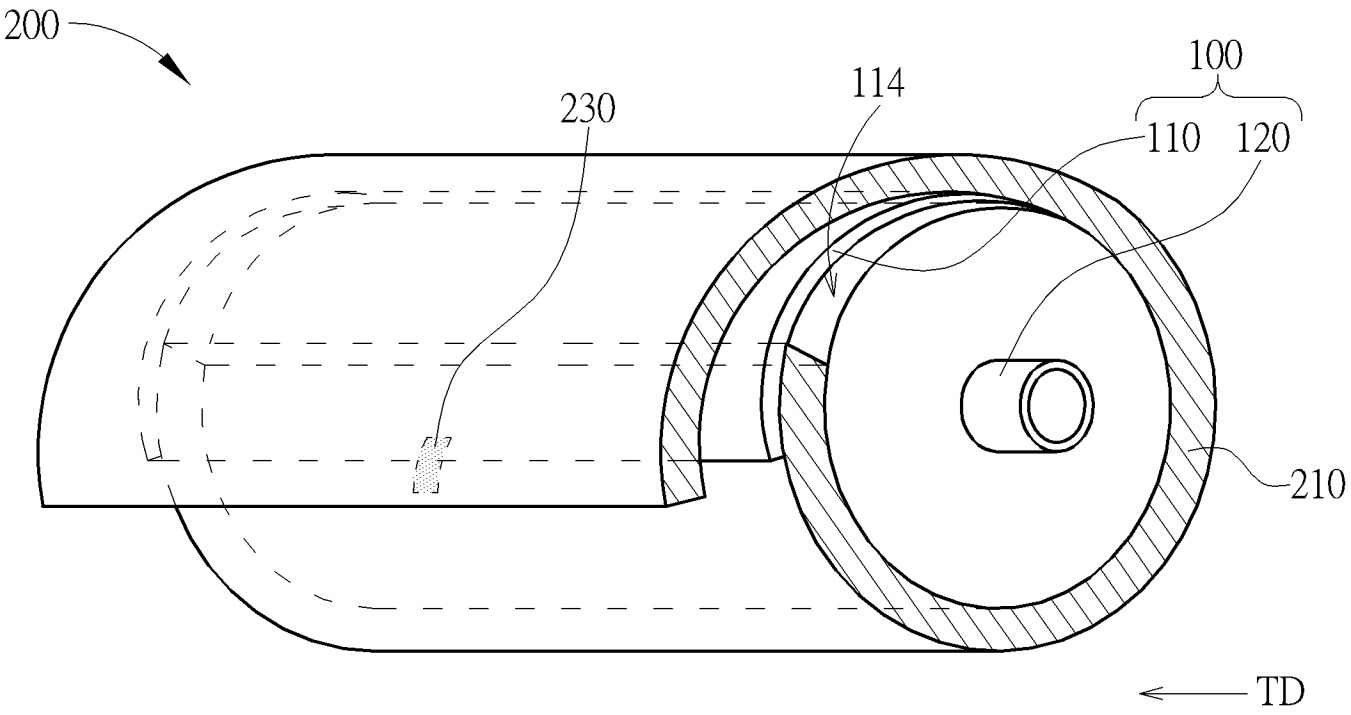
FIG. 3 is a schematic perspective view of a package structure of the roll-shaped thin film according to the embodiment.

Referring to FIG. 3, a package structure of a roll-shaped thin film 200 includes the thin film roll 100 and a buffer layer 210 wound around an outer circumference of the thin film roll 100. In particular, one end portion of the buffer layer 210 is sandwiched between the outermost thin films 110 and the adjacent inner thin film 110, and a cavity 114 is formed thereby. In addition, in order to prevent a relative displacement between the buffer layer 210 and the thin film roll 100, a connecting element 230, such as an adhesive tape, may be used in a way that two ends of the connecting element 230 are attached to the outermost thin film 110 and the buffer layer 210 respectively, so that the buffer layer 210 is relatively immobilized with respect to the thin film roll 100.

Figure 4:
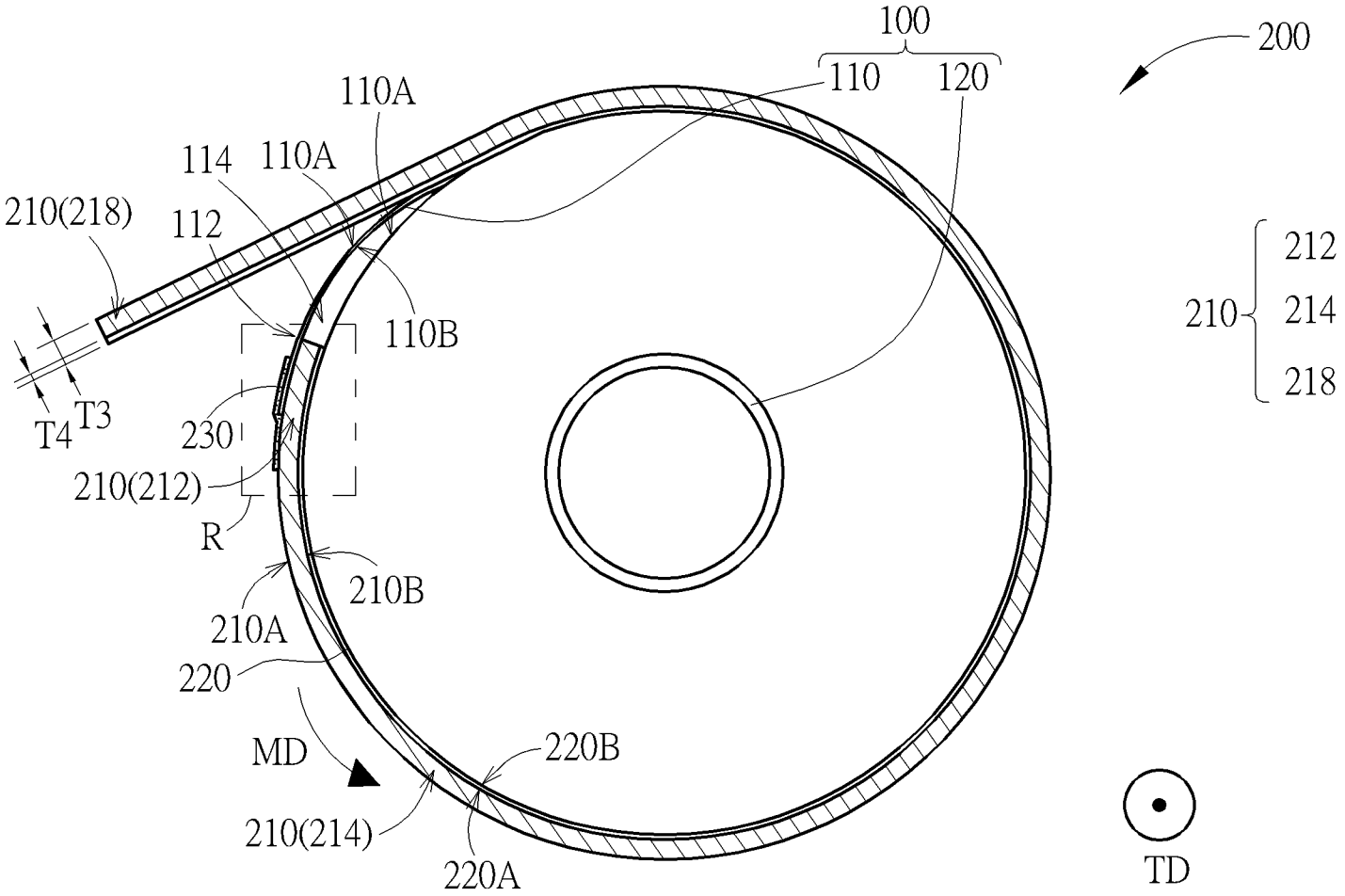
FIG. 4 is a schematic side view of a package structure of the roll-shaped thin film according to the embodiment.

FIG. 4 is a schematic side view of the package structure of the roll-shaped thin film, for example, a schematic view illustrating the package structure of the roll-shaped thin film of FIG. 3 viewing along the transverse direction TD. According to the relative positions of different sections of the buffer layer 210 with respect to the thin film roll 100, the buffer layer 210 may be deemed to include an initial portion 212, a middle portion 214 and a terminal portion 218. The initial portion 212 is a section near an end portion 112 of the thin film 110, and a portion of the outer circumference 210A of the initial portion 212 is covered with the inner circumference 110B of the end portion 112 of the thin film 110. Therefore, the initial portion 212 is sandwiched between the end portion 112 of the thin film 110 and the underlying thin film 110 of the adjacent inner round, and a cavity 114 is formed thereby. Two ends of the middle portion 214 are connected to the initial portion 212 and the terminal portion 218, respectively, and the middle portion 214 is disposed along the outer circumference 110A of the thin film roll 100. The terminal portion 218 may be a section near the end portion 112 of the thin film 110, but is not limited thereto. For example, an inner circumference 210B of the terminal portion 218 may cover the end portion 112 of the thin film 110 and the initial portion 212 of the buffer layer 210 at the same time, or further extend to cover part of the middle portion 214 of the buffer layer 210. It should be noted that the terminal portion 218 shown in FIG. 2 is illustrated as partially developed, which means that the inner circumference 210B of the terminal portion 218 of the package structure of the roll-shaped thin film 200 would preferably cover the initial portion 212 of the buffer layer 210 instead of being suspended in the air.

The buffer layer 210 is usually made of foamed material, for example, expanded polyethylene (EVE), ethylene vinyl acetate foam, polyurethane foam, polystyrene, polypropylene, reticulated polyurethane, PVC/Nitrile rubber, and ethylene propylene diene monomer (EPDM) rubber, but is not limited thereto. In addition, in order to ensure that the buffer layer 210 exhibits required buffer properties, the thickness T3 of the buffer layer 210 may be 1-20 mm, and/or the ratio of the thickness T3 of the buffer layer 210 to the thickness T1 of the thin film 110 is greater than 4.

Since the buffer layer 210 is disposed under the inner circumference 110B of the end portion of the thin film 110, even if it is necessary to apply a certain external force to the connecting element 230 (for example, an external force toward the winding core 120) in the process of attaching the connecting element 230 to the end portion 112 of the thin film 110 and the initial portion 212, the external force may be alleviated or absorbed by the initial portion 212 below the connecting element 230 and may not be further transmitted to the thin film roll 100 below the initial portion 212. Therefore, for the thin film 110 which is easily deformed plastically by the external force applied thereto, or the thin film 110 whose surface structure is easily damaged by the external force, the thin film 110 may be effectively protected from damages by disposing the initial portion 212 of the buffer layer 210 under the connecting element 230.

In addition, in order to prevent external moisture, oxides, and/or contaminations from penetrating through the buffer layer 210 and thereby oxidizing or contaminating the thin film roll 100, one or more antirust films 220 may be additionally disposed between the buffer layer 210 and the thin film roll 100 as needed to protect the thin film roll 100 from oxidation or contamination. In the embodiment of the present disclosure, an antirust film 220 is further provided. The thickness T4 of the antirust film 220 may be smaller than the thickness T3 of the buffer layer 210, for example, in a range of 0.01 to 1 mm. The width of the antirust film 220 is controlled in a range so that the antirust film 220 does not substantially cover both ends 100A of the thin film roll 100, namely, the width of the antirust film 220 is approximately equal to or slightly larger than the width of the thin film roll 100. This arrangement may ensure that the surface of the thin film roll 100 in its full width is protected by the antirust film 220 after the antirust film 220 is used to package the thin film roll 100. In this embodiment, the width of the antirust film 220 is larger than the width of the thin film roll 100 by about 10-20 mm.

The antirust film 220 may contain a bulk matrix and additives. The bulk matrix may be polyethylene (PE), polyvinyl chloride (PVC), oriented polystyrene (OPS), polypropylene (PP), polylactic acid (PLA), polyethylene terephthalate (PET), a mixture of the above materials, a modified product of the above materials, a multi-layer composite structure of the above materials, or paper, and the additives may be a volatile corrosion inhibitor (VCI) and/or a desiccant.

On the other hand, an antistatic layer (not shown), such as paper, may be additionally disposed between the antirust film 220 and the thin film roll 100 to achieve antistatic effect, or the antistatic layer (not shown) may directly replace the antirust film 220 depending on different requirements.

Figure 5:
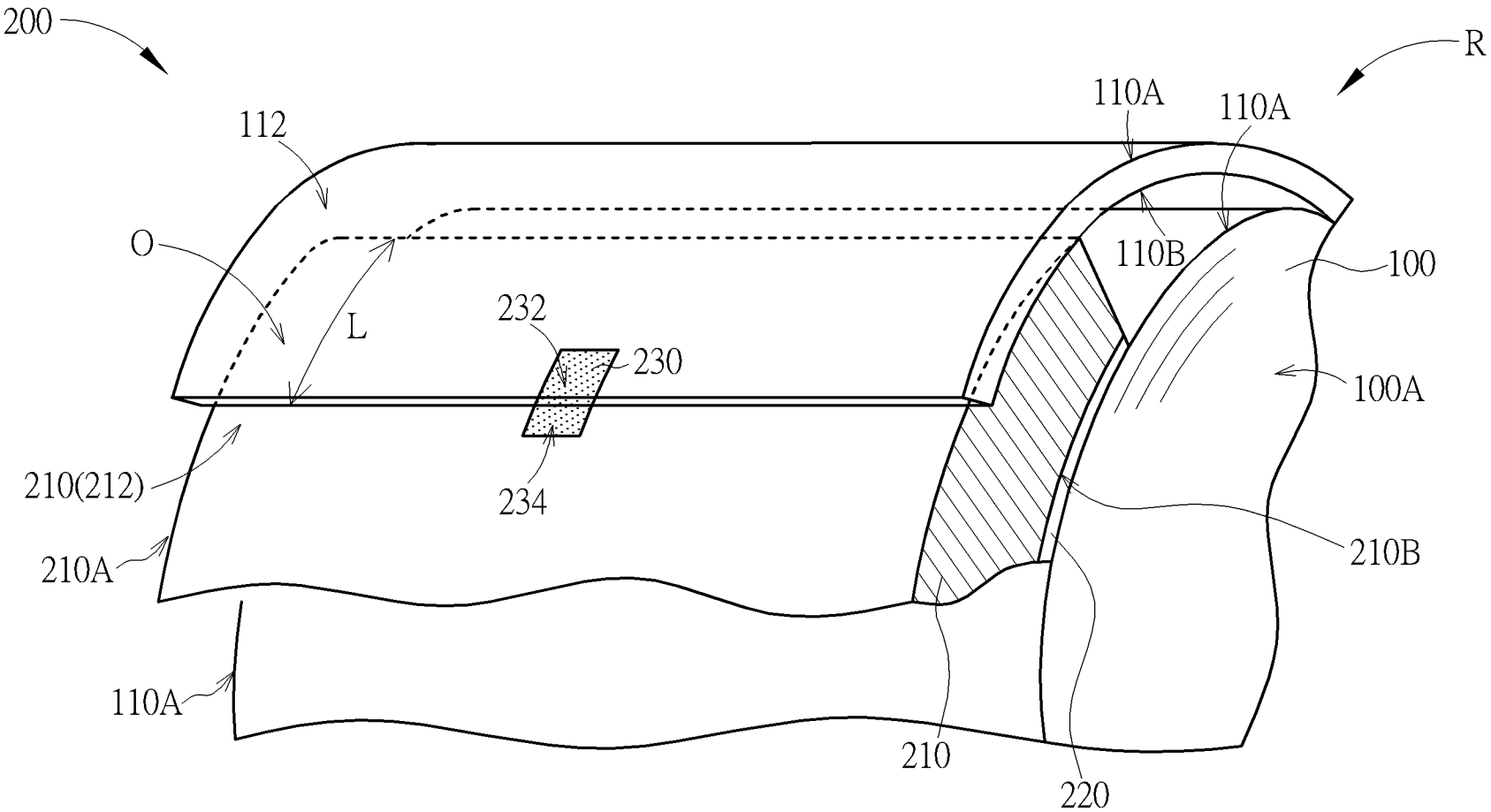
FIG. 5 is a schematic perspective view of a portion of a package structure of the roll-shaped thin film according to the embodiment.

FIG. 5 is a perspective view of a portion of a roll-shaped thin film according to the embodiment of the present disclosure, which illustrates a region R shown in FIG. 4. Referring to FIG. 5, there is an overlapping region O between the end portion 112 of the thin film 110 and the initial portion 212 of the buffer layer 210, and a length L of the overlapping region O in the mechanical direction of the thin film 110 is not less than 1 cm, for example, in a range of 1 cm to 50 cm, but not limited thereto. When the length L of the overlapping area O falls within the above range, the connecting element 230 may be allowed to be adhered to a region within a larger area. Therefore, during the process of attaching the connecting element 230, the overlapping area O may ensure that the buffer layer 210 is disposed under the connecting element 230, thus preventing the connecting element 230 from accidentally damaging the thin film 110 outside the overlapping region O, and the thin film 110 is thereby effectively protected. In addition, the connecting element 230 may be strip-shaped, such as a strip-shaped adhesive tape, and the connecting element 230 includes a first connecting end portion 232 and a second connecting end portion 234. The first connecting end portion 232 overlaps the overlapping region O and is attached to the end portion 112 of the thin film 110 by a binder or other attaching means. The second connecting end portion 234 overlaps the initial portion 212 and is attached to the initial portion 212 of the buffer layer 210 by a binder or other attaching means. Therefore, by providing the connecting element 230, relative displacement in the mechanical direction of the thin film 110 between the end portion 112 of the thin film 110 and the initial portion 212 would not occur.

Figure 6:
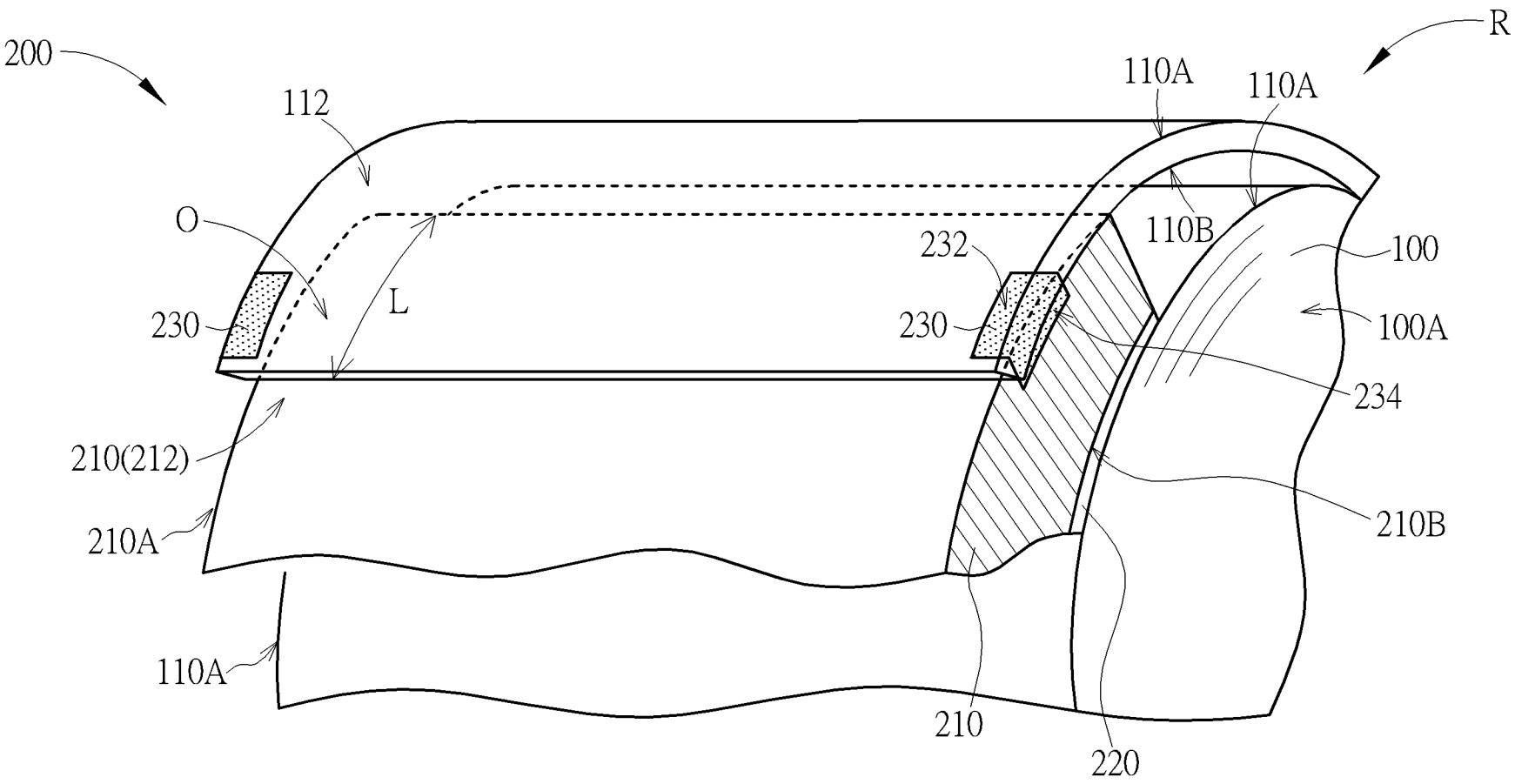
FIG. 6 is a schematic perspective view of a portion of a package structure of the roll-shaped thin film according to one variation of the embodiment.

FIG. 6 is a schematic perspective view according to a variation of the embodiment of the present disclosure, which illustrates a portion of the package structure of the rolled-shaped thin film. Referring to FIG. 6, the package structure of the rolled-shaped thin film 200 is similar to the package structure of the rolled-shaped thin film 200 shown in FIG. 5. The main difference is that the connecting elements 230 exist in pairs and are respectively disposed on both sides of the end portion 112 of the thin film 110. Similarly, the first connecting end portion 232 of each of the connecting elements 230 overlaps the overlapping region O and is attached to the end portion 112 of the thin film 110 by a binder, while the second connecting end portion 234 overlaps the side of the initial portion 212 and is attached to the side of the initial portion 212 by a binder. Therefore, relative displacement in the mechanical direction of the thin film 110 between the end portion 112 of the thin film 110 and the initial portion 212 may not occur according to this variation of the embodiment. In addition, the connection between the end portion 112 of the thin film 110 and the buffer layer 210 may be further strengthened, so that a relative displacement in the transverse direction TD is less likely to occur. As a result, more than one connecting element 230 may be used for attaching according to this variation of the embodiment. The number of the connecting elements 230 may be adjusted as required and not limited by this variation of the embodiment.

Figure 7:
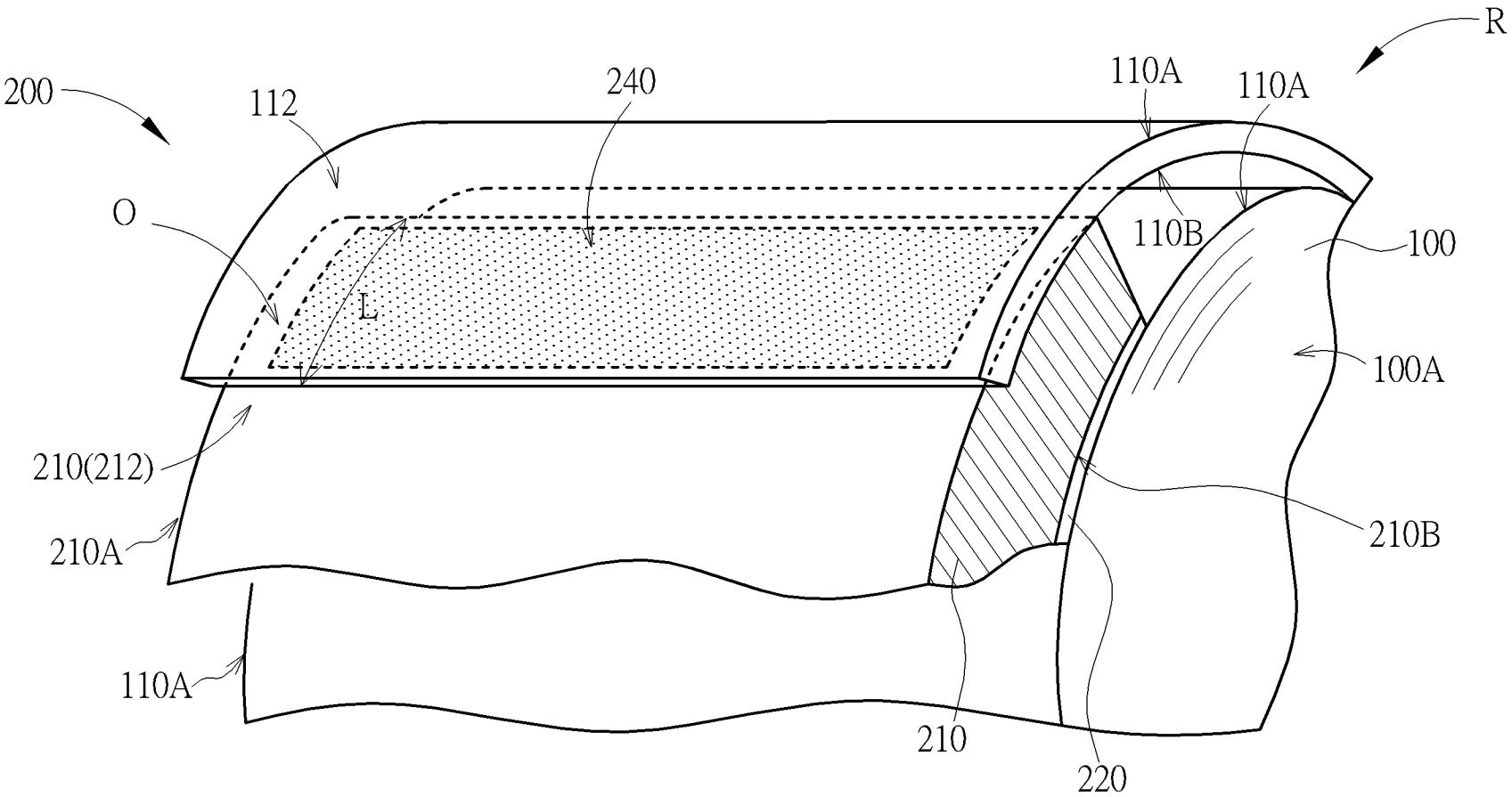
FIG. 7 is a schematic perspective view of a portion of a package structure of the roll-shaped thin film according to another variation of the embodiment.

FIG. 7 is a schematic perspective view according to another variation of the embodiment, which illustrates a portion of the package structure of the rolled-shaped thin film. Referring to FIG. 7, the package structure of the rolled-shaped thin film is similar to the package structure of the rolled-shaped thin film shown in FIG. 5. The main difference is that the connecting element 230 shown in FIG. 5 is replaced by a binder 240 shown in FIG. 7, so that the binder 240 is disposed in the overlapping region O between the end portion 112 of the thin film 110 and the initial portion 212. Therefore, a portion of the inner circumference 110B of the end portion 112 of the thin film 110 may be adhered to a portion of the outer circumference 210A of the initial portion 212 by the binder 240. According to the present variation, the binder 240 instead of the connecting element 230 is used, which means that the connecting element 230 is an optional element to attach the end portion 112 of the thin film 110 to the initial portion 212 of the buffer layer 210. In addition, the connecting element 230 and the binder 240 may also be used at the same time depending on actual requirements.

Figure 8:
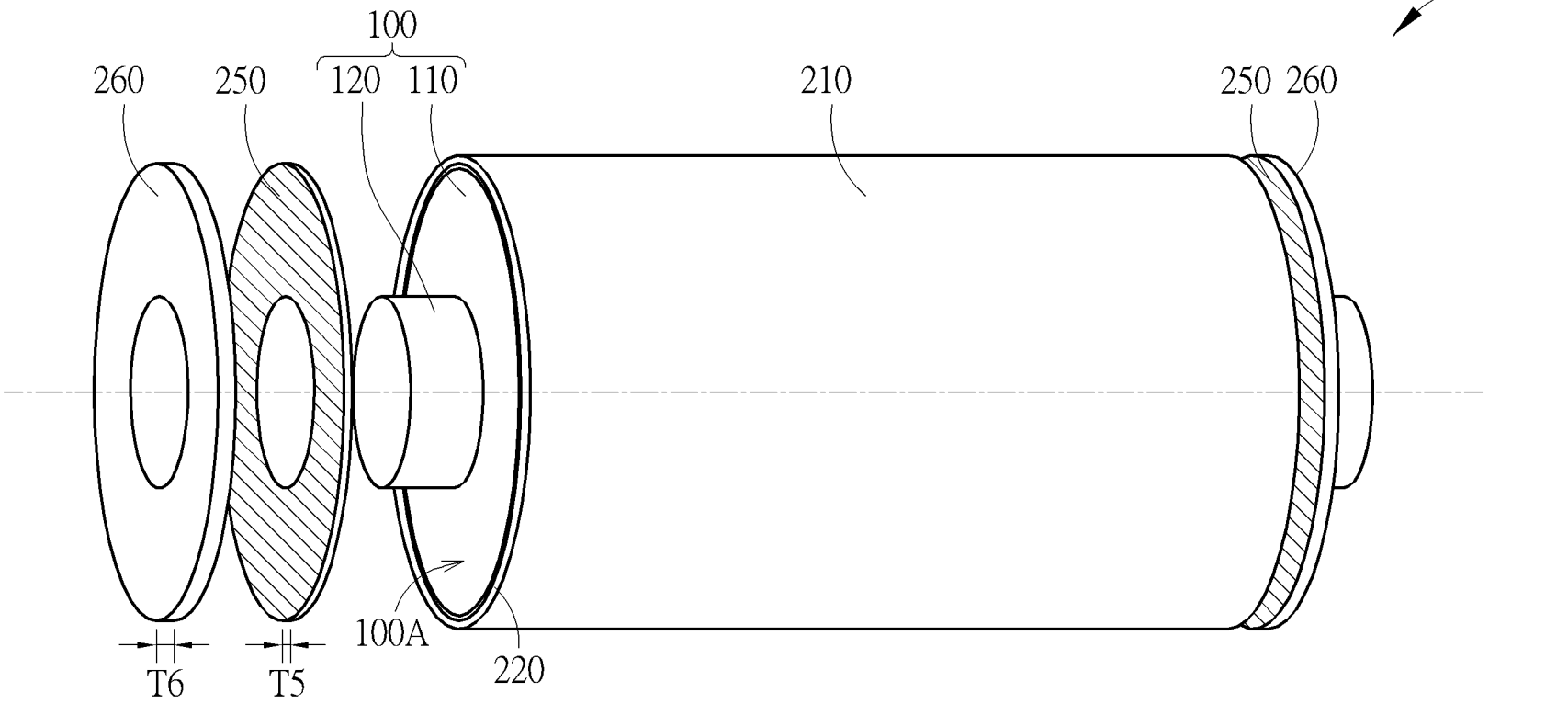
FIG. 8 is a schematic perspective view of a package structure of a roll-shaped thin film according to another embodiment of the present disclosure.
Figure 9:
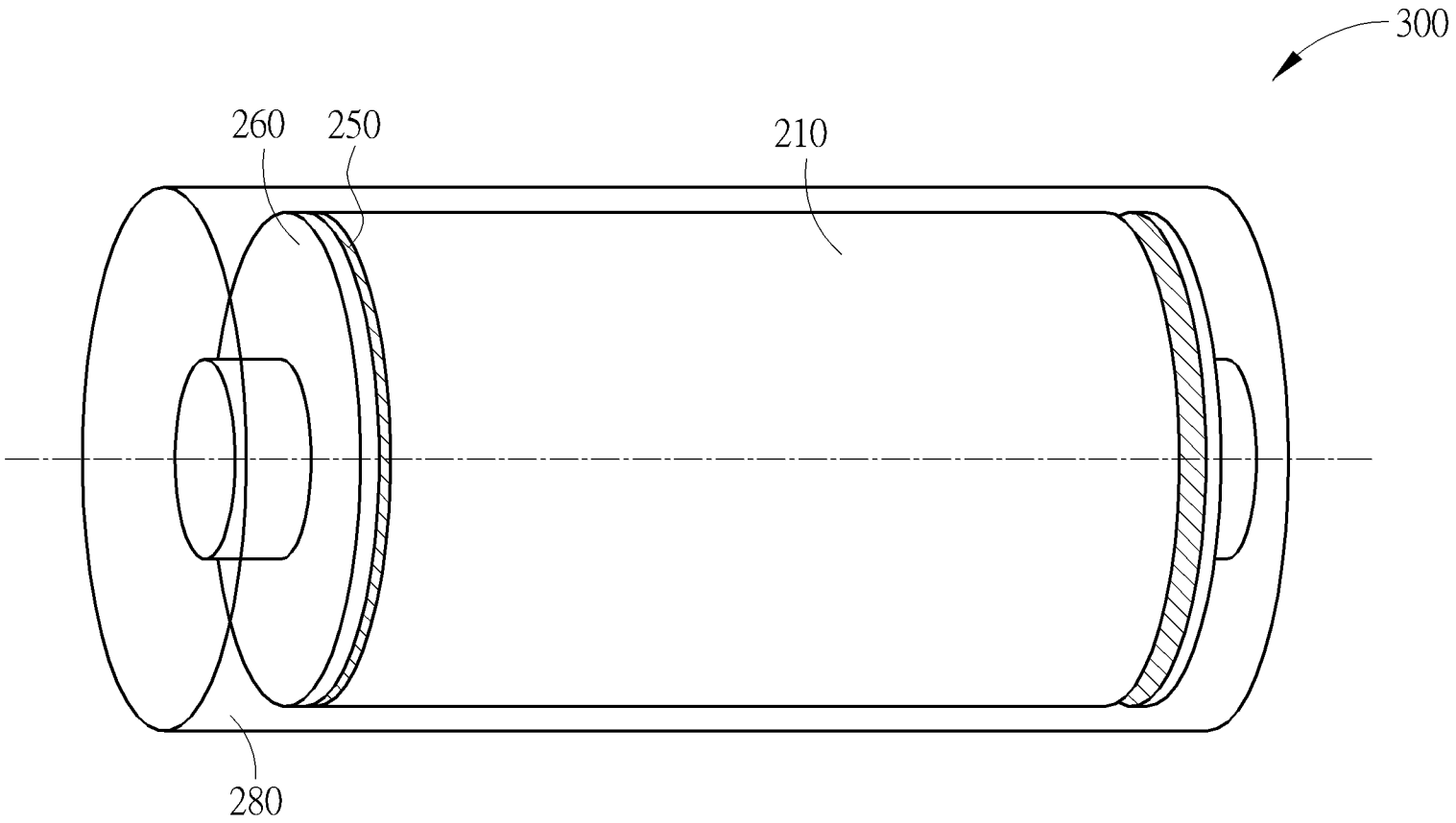
FIG. 9 is a schematic perspective view of the package structure of the roll-shaped thin film according to the another embodiment.

FIGS. 8-9 are schematic perspective views according to another embodiment of the present disclosure. A package structure of a rolled-shaped thin film 300 is the same as the structure disclosed in the previous embodiment and further includes an antirust end film 250, a buffer end cap 260, and a protective film 280.

The antirust end films 250 and the buffer end caps 260 are disposed at both ends 100A of the thin film roll 100. The composition of each of the antirust end films 250 may be similar to the composition of the antirust film 220, which may prevent external moisture, oxides, and/or contaminants from penetrating into the thin film roll 100 from both ends 100A. The composition of each of the buffer end caps 260 may be similar to the buffer layer 210, which may prevent the external force applied to the buffer end cap 260 from being transmitted to the adjacent end 100A, and therefore the thin film 110 is effectively protected from damages. The thickness T5 of each antirust end film 250 may be smaller than the thickness T6 of each buffer end cap 260, but is not limited thereto.

It is worth noting that each of the antirust end films 250 and the antirust film 220 are not continuous layers, so each of the antirust end films 250 may detachable from the antirust film 220, which facilitates the packaging process. In addition, according to actual requirements, the antirust end films 250 and the buffer end caps 260 may be used independently rather than concurrently.

The protective film 280 wraps the buffer layer 210 and the buffer end caps 260. The protective film 280 is used to not only prevent external moisture, oxides and/or contaminants from penetrating into the thin film roll 100, but also attach the antirust end films 250 and the buffer end caps 260, so that the antirust end films 250 and the buffer end caps 260 are not separated from the thin film roll 100. On the other hand, since the outer circumference and both ends of the thin film roll 100 may be covered with the buffer layer 210 and the buffer end caps 260 during wrapping the protective film 280 around the thin film roll 100, the external force applied during wrapping the protective film 280 may be absorbed by the buffer layer 210 and the buffer end caps 260 without being transmitted to the thin film roll 100.

The protective film 280 may include a bulk matrix, which may be polyethylene (PE), polyvinyl chloride (PVC), oriented polystyrene (OPS), polypropylene (PP), polylactic acid (PLA), polyethylene terephthalate (PET), a composite of the above materials, a mixture of the above materials, a modified product of the above materials or a multi-layer composite structure of the above materials.

Figure 10:
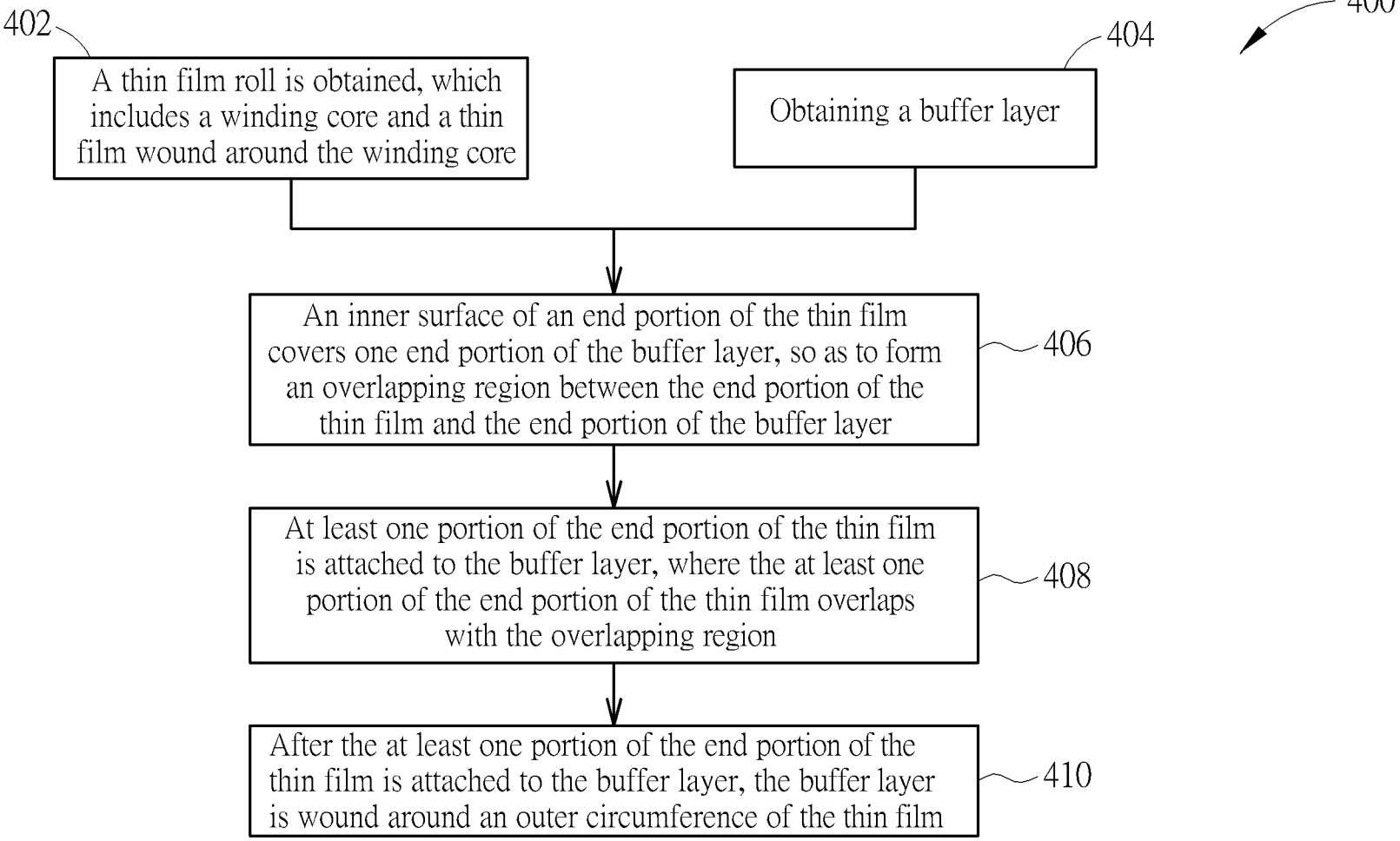
FIG. 10 is a flowchart of a packaging method of a roll-shaped thin film according to the present disclosure.

FIG. 10 is a flowchart of a packaging method of a roll-shaped thin film according to the present disclosure, which may be applied to any of the aforementioned embodiments. Referring to FIG. 10, in step 402, a thin film roll is obtained, which includes a winding core and a thin film wound around the winding core. In step 404, a buffer layer is obtained. In particular, step 402 and step 404 may be performed simultaneously or sequentially depending on actual requirements. Then, in step 406, an inner surface of an end portion of the thin film covers one end portion (or an initial portion) of the buffer layer, so that an overlapping region is formed between the end portion of the thin film and the end portion of the buffer layer. Afterwards, in step 408, at least one portion of the end portion of the thin film is attached to the buffer layer, where the at least one portion of the end portion of the thin film overlaps with the overlapping region. Subsequently, in step 410, after the at least one portion of the end portion of the thin film is attached to the buffer layer, the buffer layer is wound around an outer circumference of the thin film.

For the package structure of the roll-shaped thin film provided with the antirust film, the packaging method of the roll-shaped thin film may further include the following steps. For example, obtaining an antirust film; overlapping the antirust film and the buffer layer; covering the end portion of the buffer layer and one end portion of the antirust film with the inner surface of the end portion of the thin film; and winding the buffer layer and the antirust film around an outer circumference of the thin film. After the buffer layer and the antirust film are completely wound around the outer circumference of the thin film, the antirust film does not cover both ends of the thin film roll on completion of winding the buffer layer and the antirust film around the outer circumference of the thin film.

For the package structure of the roll-shaped thin film provided with the antirust film and the antirust end films, after winding the buffer layer around the outer circumference of the thin film, the packaging method of the roll-shaped thin film may further include the following steps. For example, obtaining two antirust end films; and covering both ends of thin film roll with each of the antirust end films respectively, where each of the antirust end films is detachable from the antirust film.

For the package structure of the roll-shaped thin film provided with the buffer end caps, after winding the buffer layer around the outer circumference of the thin film, the packaging method of the roll-shaped thin film may further include the following steps. For example, obtaining two buffer end caps; and covering both ends of the thin film roll with each of the buffer end caps.

In order to enable a person having ordinary skill in the art to implement the present disclosure, the specific examples regarding a package structure of a roll-shaped thin film and a packaging method thereof are further elaborated below. It should be noted, however, that the following examples are for illustrative purposes only and should not be construed to limit the present disclosure. That is, the materials, and the processing flow in the respective examples may be appropriately modified so long as these modifications are within the spirit and scope of the present disclosure as defined by the appended claims.

EXAMPLES

Example 1

Example 1 is a packaging method of a roll-shaped thin film to obtain the corresponding package structure of the roll-shaped thin film. First, a copper foil with a width of 20 cm and a thickness of 4 μm is used as a thin film, and the copper foil is wound around a winding core continuously until the outer diameter of the obtained thin film roll reaches 15 cm. Then, expanded polyethylene (EVE) with a thickness of 2 mm is obtained as a buffer layer, and then the buffer layer is stacked on an antirust film. Afterward, an inner surface of an end portion of the thin film covers one end portion of the buffer layer and the antirust film, thereby forming an overlapping region between the end portion of the thin film and the buffer layer, and the length of the overlapping region in the mechanical direction is about 3 cm. Then, one end portion of an adhesive tape is attached to the end portion of the thin film, and the end portion of the adhesive tape is located within the overlapping region. Then, the other end portion of the adhesive tape is attached to the buffer layer so that the buffer layer and the end portion of the thin film are attached to each other. Afterward, the buffer layer and the antirust film are wound around the outer circumference of the thin film roll. Subsequently, antirust end films and buffer end caps may be sequentially stacked on both ends of the thin film roll. Finally, a protective film is used to wrap around the thin film roll. Other specific conditions and parameters of Example 1 are shown in TABLE 1.

Examples 2-7

Examples 2-7 are packaging methods of roll-shaped thin films to obtain the corresponding package structures of the roll-shaped thin films. The thin films of Examples 2-7 are copper foils, and the processing flow is similar to that of Example 1 above. Different processing conditions and parameters are shown in TABLE 1.

Comparative Examples 1-6

Comparative Examples 1-6 are packaging methods of roll-shaped thin films to obtain the corresponding package structures of the roll-shaped thin films. The thin films of Comparative Examples 1-6 are copper foils, and the processing flow is similar to that of Example 1 above. Different processing conditions and parameters are shown in TABLE 1.

The test results of the aforementioned Examples 1-7 and Comparative Examples 1-6, such as <Length of damaged thin film> is further elaborated below. The results are shown in TABLE 1

<Length of Damaged Thin Film>

Since an external force applied to the end portion of the thin film may be transmitted to a certain depth from the surface of a thin film roll during attaching the adhesive tape, an inspection is performed after the packaging methods of the aforementioned Examples 1-7 and Comparative Examples 1-6 are completed. The package structures may be unpacked to obtain the corresponding thin film rolls, and the thin film rolls are then developed along the mechanical direction and inspected to check whether there are dents, caused by attaching the adhesive tape, on the surface of the thin film. The total length between an edge at the end portion of the thin film and the dent (or last dent) farthest from the edge at the end portion of the thin film is measured, which is the length of the damaged thin film.

TABLE 1

| | Thickness of copper foil (μm) | Width (cm) | Thickness of buffer layer (mm) | Overlapping length (cm) | Antirust film | length of damaged thin film (m) |
|---|---|---|---|---|---|---|
| Ex. 1 | 4 | 20 | 2 | 1 | PE | <0.5 |
| Ex. 2 | 4 | 80 | 5 | 3 | PE | <0.5 |
| Ex. 3 | 4 | 100 | 10 | 5 | PE | <0.5 |
| Ex. 4 | 4 | 140 | 20 | 7 | PE | <0.5 |
| Ex. 5 | 20 | 100 | 2 | 7 | PE | <0.5 |
| Ex. 6 | 70 | 100 | 2 | 3 | PE | <0.5 |
| Ex. 7 | 105 | 100 | 1 | 3 | PE | <0.5 |
| c.f. 1 | 4 | 100 | 0.2 | 5 | PE | 10 |
| c.f. 2 | 4 | 100 | N.A. | N.A. | PE | 30 |
| c.f. 3 | 4 | 100 | 2 | N.A. | PE | 20 |
| c.f. 4 | 4 | 100 | 10 | N.A. | PE | 20 |
| c.f. 5 | 70 | 100 | N.A. | N.A. | PE | 5 |
| c.f. 6 | 105 | 100 | 2 | N.A. | PE | 1.5 |

According to TABLE 1, for Examples 1-6, when the thickness of the buffer layer is at least 1 mm and the length of the overlapping region between the end portion of the thin film and the buffer layer is at least 1 cm, each of the corresponding lengths of the damaged thin films is less than 0.5 m. In contrast, for Comparative Examples 2-6, when the buffer layer is not provided or the buffer layer is not covered with the end portion of the thin film, each of the corresponding lengths of the damaged thin films is still at least 5 m. In addition, for Comparative Example 1, even though the buffer layer is covered with the end portion of the thin film, the corresponding length of the damaged thin film is still at least 10 m when the thickness of the buffer layer is less than 1 mm (e.g., 0.2 mm).

As a result, by sandwiching the initial portion of the buffer layer between the end portion of the thin film and its underlying thin film roll, the external force applied to the end portion of the thin film may be buffered or absorbed by the initial portion of the buffer layer, and may not be further transmitted to the thin film roll below the initial portion. Therefore, for a thin film which is easily deformed plastically by an external force, or for a thin film whose surface structure is easily damaged by an external force, the thin film may be effectively prevented from being damaged by sandwiching the initial portion of the buffer layer between the end portion of the thin film and its underlying thin film roll.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A package structure of a roll-shaped thin film, comprising:

a thin film roll, comprising a winding core and a thin film wound around the winding core; and a buffer layer wound around an outer circumference of the thin film, an initial portion of the buffer layer is covered with an inner surface of an end portion of the thin film, and a portion of the buffer layer is attached to the end portion of the thin film, wherein the thickness of the buffer layer is in a range of 1-20 mm;

wherein there is an overlapping region between the initial portion of the buffer layer and the end portion of the thin film, and the length of the overlapping region along a mechanical direction of the thin film is not less than 1 cm.

2. The package structure of the roll-shaped thin film of claim 1, wherein the thin film is a metal foil.

3. The package structure of the roll-shaped thin film of claim 1, wherein the ratio of the thickness of the buffer layer to the thickness of the thin film is more than 4.

4. The package structure of the roll-shaped thin film of claim 1, wherein the length of the overlapping region along the mechanical direction is in a range of 1 cm to 50 cm.

5. The package structure of the roll-shaped thin film of claim 1, wherein the portion of the buffer layer is attached to the end portion of the thin film by a connecting element or a binder.

6. The package structure of the roll-shaped thin film of claim 5, wherein the connecting element comprises a first connecting end portion and a second connecting end portion, wherein the first connecting end portion is attached to the end portion of the thin film, and the second connecting end portion is attached to the portion of the buffer layer.

7. The package structure of the roll-shaped thin film of claim 1, further comprises an antirust film, wherein the antirust film is sandwiched between the thin film and the buffer layer, and the antirust film does not cover both ends of the thin film roll.

8. The package structure of the roll-shaped thin film of claim 7, further comprises two antirust end films disposed at both ends of the thin film roll respectively, and each of the antirust end films is detachable from the antirust film.

9. The package structure of the roll-shaped thin film of claim 1, further comprises two buffer end caps disposed at both ends of the thin film roll respectively.

10. A packaging method of a roll-shaped thin film, comprising:

obtaining a thin film roll, wherein the thin film roll comprises a winding core and a thin film wound around the winding core;

obtaining a buffer layer;

covering an initial portion of the buffer layer with an inner surface of an end portion of the thin film, so as to form an overlapping region between the initial portion of the buffer layer and the end portion of the thin film;

attaching at least one portion of the end portion of the thin film to the buffer layer, wherein the at least one portion of the end portion of the thin film overlaps with the overlapping region; and after attaching the at least one portion of the end portion of the thin film to the buffer layer, winding the buffer layer around an outer circumference of the thin film.

11. The packaging method of the roll-shaped thin film of claim 10, wherein the thin film is a metal foil.

12. The packaging method of the roll-shaped thin film of claim 10, wherein the ratio of the thickness of the buffer layer to thickness of the thin film is more than 4.

13. The packaging method of the roll-shaped thin film of claim 10, wherein the length of the overlapping region along a mechanical direction of the thin film is not less than 1 cm.

14. The packaging method of the roll-shaped thin film of claim 10, wherein the at least one portion of the end portion of the thin film is attached to the buffer layer by an adhesive tape or a binder.

15. The packaging method of the roll-shaped thin film of claim 10, further comprising:

obtaining an antirust film;

overlapping the antirust film and the buffer layer;

covering the initial portion of the buffer layer and an end portion of the antirust film with the inner surface of the end portion of the thin film; and winding the buffer layer and the antirust film around an outer circumference of the thin film.

16. The packaging method of the roll-shaped thin film of claim 15, wherein the antirust film does not cover both ends of the thin film roll on completion of winding the buffer layer and the antirust film around the outer circumference of the thin film.

17. The packaging method of the roll-shaped thin film of claim 16, wherein, after winding the buffer layer and the antirust film around the outer circumference of the thin film, further comprising:

obtaining two antirust end films; and covering both ends of the thin film roll with the antirust end films respectively, wherein each of the antirust end films is detachable from the antirust film.

18. The packaging method of the roll-shaped thin film of claim 10, wherein, after winding the buffer layer around an outer circumference of the thin film, further comprising:

obtaining two buffer end caps; and covering both ends of the thin film roll with each of the buffer end caps.

* * * * *